US007346297B2

(12) United States Patent
Kawakami et al.

(10) Patent No.: US 7,346,297 B2
(45) Date of Patent: Mar. 18, 2008

(54) DEVELOPING CARTRIDGE HAVING A LID WITH A CHANGEABLE SHAPE

(75) Inventors: Tomoyuki Kawakami, Niigata (JP); Akihiro Kasuga, Niigata (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/189,720

(22) Filed: Jul. 27, 2005

(65) Prior Publication Data

US 2006/0204284 A1 Sep. 14, 2006

(30) Foreign Application Priority Data

Mar. 14, 2005 (JP) ..... P.2005-070535

(51) Int. Cl.
*G03G 15/08* (2006.01)

(52) U.S. Cl. ..... 399/254; 399/262; 399/111; 399/114

(58) Field of Classification Search ..... 399/109, 399/111, 113, 114, 254, 262
See application file for complete search history.

(56) References Cited

U.S. PATENT DOCUMENTS 5,966,568 A * 10/1999 Numagami et al. ..... 399/111
5,987,278 A * 11/1999 Nomura et al. ..... 399/109
6,347,207 B1 * 2/2002 Ishiguro et al.
2005/0163530 A1 * 7/2005 Miller ..... 399/113

FOREIGN PATENT DOCUMENTS

JP 03288874 A * 12/1991
JP 10-187008 A 7/1998

* cited by examiner

*Primary Examiner*—David M. Gray
*Assistant Examiner*—Laura K Roth
(74) *Attorney, Agent, or Firm*—Sughrue Mion, PLLC

(57) ABSTRACT

A developing cartridge including: a developing part having a developer bearing member; a developer container which is constituted by coupling a container body having an opening part and a developer supplying port, and a lid member for closing the opening part, and which houses developer therein; and a developer stirring member which stirs the developer inside this developer container and supplies the developer to the developer bearing member, wherein the shape and the capacity of the developer container are changed by changing the shape of the lid member.

2 Claims, 5 Drawing Sheets

DEVELOPING CARTRIDGE HAVING A LID WITH A CHANGEABLE SHAPE

BACKGROUND OF THE INVENTION

1. Field of the Invention

The present invention relates to a developing cartridge in a printer, a copying machine or a facsimile.

2. Background Art

In the conventional image forming apparatus, as a process cartridge (developing cartridge) for a small amount of toner, a process cartridge, in which a toner container (developer container) having the capacity suited to the toner amount is formed by a partition plate provided in the toner container, has been known (JP-A-10-187008).

In case of the above process cartridge, the angle of the downward slant surface of the toner container is regulated, which is effective when the capacity of the toner container on the upside of a stirring member is changed. However, it is difficult to change the capacity of the toner container in the horizontal direction of the stirring member or the capacity of the toner container on the downside of the stirring member.

Further, in the above process cartridge, in case that it is thought to change the capacity of the toner container in the horizontal direction of the stirring member or the capacity of the toner container on the downside of the stirring member, since the structure condition of the toner stirring member is based on a case in which the capacity of the toner container is large, toner stirring/supplying power by the toner stirring member is different between the toner containers having the different capacity. Therefore, there is fear that a difference in image quality is produced. Further, in development of an electrophotographic apparatus, when a cartridge is partially used in common between the plural electrophotographic apparatuses, since the contour and the shape of the cartridge are fixed, freedom of parts arrangement and miniaturization of the electrophotographic apparatus is removed. Further, in case of the above process cartridge, regardless of the amount of toner filled in the toner container, the cartridge structure is common, so that it is difficult to reduce the cost.

SUMMARY OF THE INVENTION

An object of the invention is to provide a developing cartridge and an image forming apparatus, in which a developer container having the shape and the capacity which are suited to the desired amount of the housed developer can be obtained. Further, another object is to provide a developing cartridge and an image forming apparatus, in which the contour and the shape of the developing cartridge can be freely set according to the electrophotographic apparatus when the developing cartridge is partially used in common between the plural electrophotographic apparatuses according to necessity,.

In order to solve the problems, a developing cartridge of the invention includes a developing part having a developer bearing member; a developer container which is constituted by coupling a container body having an opening part and a developer supplying port, and a lid member for closing the opening part, and which houses developer therein; and a developer stirring member which stirs the developer inside this developer container and supplies the developer to the developer bearing member, wherein the shape and the capacity of the developer container are changed by changing the shape of the lid member. Hereby, the developer container suited to the desired amount of the housed developer can be obtained. Further, when a the developer cartridge is partially used in common between plural electrophotographic apparatuses according to necessity, the contour and the shape of the developing cartridge can be freely set according to the electrophotographic apparatus.

In the developing cartridge, it is preferable that at least one of the rotational center position of the developer stirring member, the radius of rotation thereof, the number of rotations thereof, and the length and the thickness thereof is set according to the shape and the capacity of the developer container. Hereby, the supply power (push power) and the supply angle at the supply port when the developer is supplied to the developer bearing member by the developer stirring member become constant regardless of the shape and the capacity of the developer container. Therefore, the supply amount of the developer to be transported to the developer bearing member becomes constant, so that an image quality difference due to the amount of developer is not caused.

In the developing cartridge, it is preferable that plural rotation shafts of the developer stirring member are provided, which are different from each other in rotational center position, and selected and used according to the shape and the capacity of the developer container. Hereby, the supply power and the supply angle at the supply port when the developer is supplied to the developer bearing member by the developer stirring member become constant regardless of the shape and the capacity of the developer container. Therefore, the supply amount of the developer to be transported to the developer bearing member becomes constant, so that an image quality difference due to the amount of developer is not caused. Further, the developer stirring member can be partially used in common.

In the developing cartridge, it is preferable that a gear train in which gears for transmitting drive to the developer stirring member are arranged is provided in the developer container; the gears in the gear train are arranged in a multistep manner; and at least a part of the gear train is common and the partial gears in the gear train are recombined according to the rotational center position of the developer stirring member. Hereby, at least a part of the developer stirring member can be used in common.

According to the second aspect of the invention, a developing cartridge includes a developing part having a developer bearing member; a developer container which is constituted by coupling a container body having an opening part and a developer supplying port, and a lid member for closing the opening part, and which houses developer therein; and a developer stirring member which stirs the developer inside this developer container and supplies the developer to the developer bearing member, wherein the developing part is used in common, and the developer container can be exchanged for another developer container having the desired capacity and shape. Hereby, unitization of the developing part and the developer container can become possible, which is advantageous in assembly of the developing cartridge. Further, when the developing cartridge is reused, the exchange for a developer container that meets the demand can be performed.

In the developing cartridge, it is preferable that at least one of the rotational center position of the developer stirring member, the radius of rotation thereof, the number of rotations thereof, and the length and the thickness thereof is set according to the shape and the capacity of the developer container. Hereby, the supply power and the supply angle at the supply port when the developer is supplied to the developer bearing member by the developer stirring member become constant regardless of the shape and the capacity of the developer container. Therefore, the supply amount of the developer to be transported to the developer bearing member becomes constant, so that an image quality difference due to the amount of developer is not caused.

In the developing cartridge, it is preferable that the developer container is attached detachably to the body of the developing cartridge. Hereby, exchange of the developer container can be performed by a user, and the user can select the capacity of the developer container according to necessity. Further, between various types of apparatuses, the developer container can be used in common. Further, when the developing cartridge is reused, regardless of the kind of the developer used firstly, that is, regardless of the kind of developer used firstly, for example, color developer and monochromatic developer, various kinds of developer can be used.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Embodiments of the invention will be described with reference to drawings.

Figure 1:
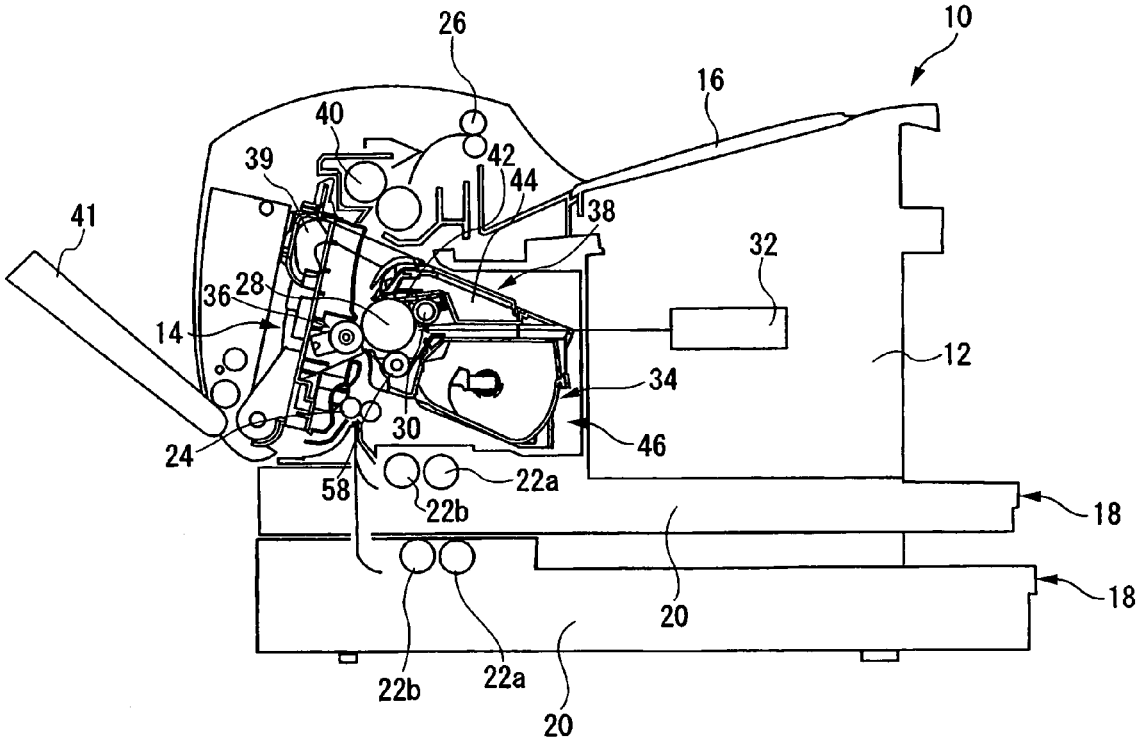
FIG. 1 is a sectional view of an image forming apparatus according to an embodiment of the invention.

FIG. 1 shows an outline of an image forming apparatus 10 according to an embodiment of the invention. The image forming apparatus 10 includes an image forming apparatus body 12. In this image forming apparatus body 12, an image forming unit 14 is mounted; at the upper portion of this image forming apparatus body 12, a discharge part 16 is provided; and at the lower portion of this image forming apparatus body 12, for example, two-step paper supply unit 18, 18 is arranged.

Each paper supply unit 18 includes a paper supply cassette 20 in which paper is housed, and paper supply rolls 22*a*, 22*b*. By rotation of these paper rolls 22*a*, 22*b*, the paper stacked on the paper supply cassette 20 is transported to a regist roll 24.

Further, on the downstream side of the regist roll 24, an image bearing body 28 in a process cartridge (developing cartridge) 46 which will be described later and a transfer unit 36 are arranged opposed to each other. Further, on the more downstream side, a fixing device 40 is provided.

Accordingly, the paper fed out from the paper supply cassette 20 of the paper supply unit 18 by the paper supply rolls 22*a* and 22*b* is temporarily stopped by the regist roll 24, and thereafter transported between the image bearing member 28 and the transfer unit 36 with timing, whereby a developer image is transferred onto the paper. Next, this transferred developer image is fixed by the fixing device 40, and the paper is discharged to the discharge part 16 by a discharge roll 26.

On the other hand, on a side surface (left side surface in FIG. 1) of the image forming apparatus body 12, for example, a hand-insertion unit 41 is arranged. The paper fed out from this hand-insertion unit 41, similarly to the paper fed out from the paper supply unit 18, is temporarily stopped by the regist roll 24, and thereafter transported between the image bearing member 28 and the transfer unit 36 with timing, whereby a developer image is transferred onto the paper. Next, this transferred developer image is fixed by the fixing unit 40, and the paper is discharged to the discharge part 16 by the discharge roll 26.

The image forming unit 14, which is an electrophotographic type, includes the image bearing member 28 composed of a photoconductor; a charging device 30 composed of, for example, a charge roll, by which this image bearing member 28 is uniformly charged; a light writing device 32 which writes a latent image by light onto the image bearing member 28 charged by this charging device 30; a developing device 34 which makes visible the latent image on the image bearing member 28 that has been formed by this light writing device 32 by use of developer; the transfer device 36 which transfers an image developed by the developing device 34 onto paper by receiving the predetermined voltage; a cleaning device 38 which cleans the developer remaining on the image bearing member 28; and the fixing device 40 composed of, for example, a pressure roll and a heat roll, which fix the developer image transferred onto the paper by the transfer device 36 onto the paper. The light writing device 32 is composed of, for example, a scanning type laser exposing device, which scans in the process cartridge 46 described later and forms a latent image on the image bearing member 28. The cleaning device 38 includes a cleaning blade 42 which comes into contact with the image bearing member 28, and a developer collecting part 44 which houses therein the developer scraped off by this cleaning blade 42.

Further, the light writing device 32, in another embodiment, can use a LED or a surface emitting laser.

Next, the process cartridge (developing cartridge) 46 according to one embodiment of the invention will be described with reference to the drawings.

Figure 2A:
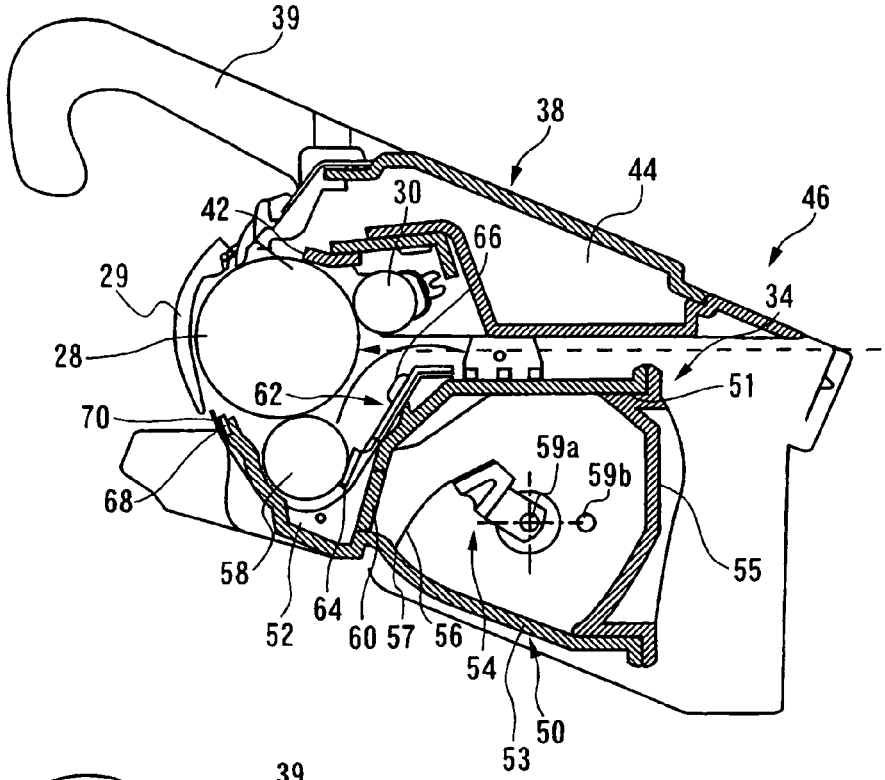
FIGS. 2A and 2B are section views showing an outline of a process cartridge according to a first embodiment of the invention.
Figure 2B:
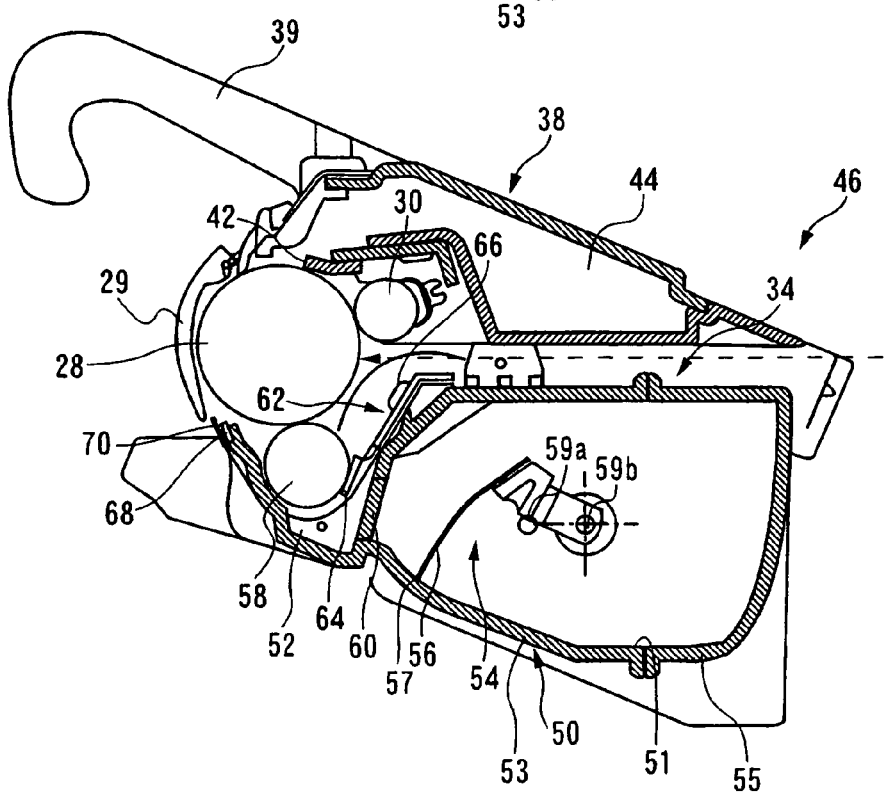
Figure 3:
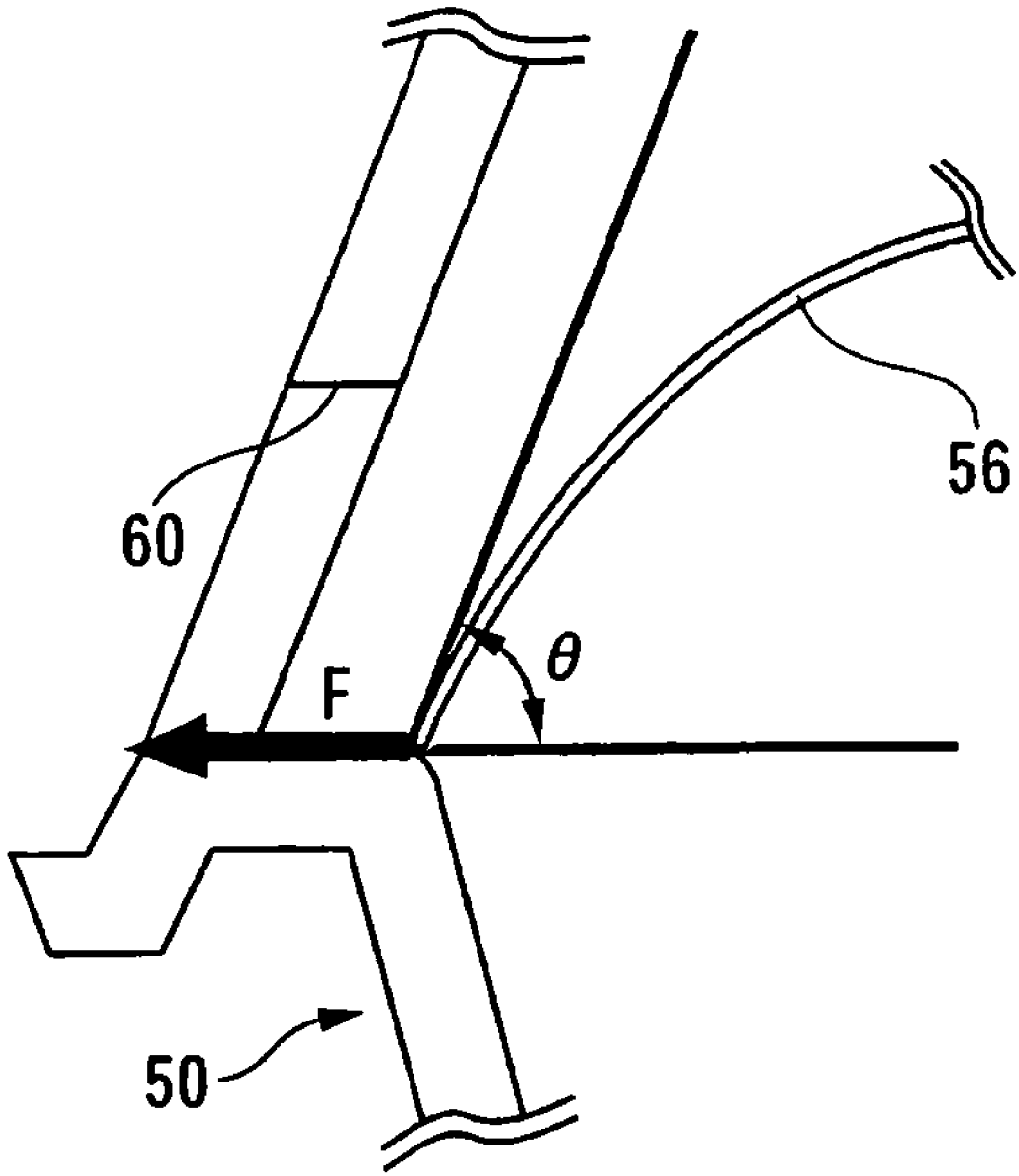
FIG. 3 is a sectional view showing a state of a main part of the process cartridge according to the first embodiment of the invention.

FIGS. 2A and 2B show an outline of the process cartridge 46 according to one embodiment of the invention.

The process cartridge 46 is formed by integrating the image bearing member 28, the charging device 30, the developing device 34 and the cleaning device 38, and these can be integrally exchanged. In the process cartridge 46, an opening and closing cover 29 is provided on the outside of the image bearing member 28. This opening and closing cover 29 is located, in a state where the process cartridge 46 is not attached to the image forming apparatus body 12, in a position where the cover 29 covers the image bearing member 28. When the process cartridge 46 is about to be attached to the image forming apparatus body 12, the opening and closing cover 29 moves upward of the image bearing member 28, so that the image bearing member 28 appears on the outer surface of the process cartridge 46. When the process cartridge 46 has been attached to the image forming apparatus body 12, the image bearing member 28 and the transfer device 36 face each other as shown in FIG. 1. Further, for this process cartridge 46, a handle 39 is provided, which extends from the cleaning device 38 to the oblique upside and has a leading end curved downward. Therefore, when the process cartridge 46 is taken out from the image forming apparatus body 12, by pulling out the process cartridge 46 with the handle 39, the process cartridge 46 can be readily taken out from the image forming apparatus body 12.

The developing device 34 is divided into a developer container 50 which houses developer therein and a developing part 52. The developer container 50 includes a container body 53 having an opening part 51 formed on a surface on the opposite side to the side where the image bearing member 28 is arranged, and a lid member 55 which closes this opening part 51. By changing the shape of this lid member 55, the shape and the capacity of the developer container 50 can be changed. Namely, for example, by exchanging the lid member 55 shown in FIG. 2A to the lid member 55 shown in FIG. 2B which is so shaped as to expand on the opposite side to the side where the image bearing member 28 is arranged, the capacity of the developer container 50 can be made large.

This developer container 50 includes an agitator (developer stirring member) 54 therein. This agitator 54 has a stir plate 56 made of flexible material such as PET (polyethylene terephthalate). As the amount of toner in the developer container 50 decreases, a leading end part 57 of this stir plate 56 rotates while coming contact with the inner wall of the developer container 50. The developer container 50 communicates with the developing part 52 through a developer supplying port 60, and the developer is transported from this developer supplying port 60 to the developing part 52.

In the developing part 52, a developing roll (developer bearing member) 58 having a magnet roll therein is arranged. This developing roll 58 faces the image bearing member 28 at the lower portion of the image bearing member 28, and this facing part is a developing position. Further, to this developing roll 58, the predetermined voltage is applied.

A blade device 62 includes a development blade 64 and an attachment part 66. The development blade 64 is made of elastic resin such as polyurethane, silicon, or the like, and arranged in the developing part 52. This development blade 64 has one end fixed to the developer container 50 through the attachment part 66. The attachment part 66 is made of sheet metal, and one end of the development blade 64 is fixed to this attachment part 66 by hot melt. Further, the development blade 64, before its other end, deforms elastically and comes into contact with the developing roll 58. The layer thickness of the developer on the developer roll 58 is regulated by this development blade 64, and using the developer of which the layer thickness is regulated, a latent image on the image bearing member 28 is developed in the developing position.

Further, the process cartridge 46 has a conductive member 68 made of a film-shaped sheet on the upstream side in the paper transporting direction in the position where the image bearing member 28 faces the transfer device 36 when the process cartridge 46 is attached to the image forming apparatus body 12. This conductive member 68 is formed of a sheet having the nearly same length as each axial length of the transfer device 36 and the image bearing member 28. To this conductive member 68, the voltage equal to the voltage applied to the developing roll 58 is applied by a circuit branched from the circuit by which the voltage is applied to the developing roll 58. By thus providing the conductive member 68, scatter toner produced in development can be attached electrically on the conductive member 68, so that stains in the image forming apparatus body 12 with the scatter toner can be prevented. Further, this conductive member 68 is covered with an insulation film 70 on its transfer device 36 side (outside of the conductive member 68) throughout the full length in the axial direction, that is, throughout the full length in the longitudinal direction. This is because: in case that the transported paper comes into contact with the conductive member 68, there is fear that leak is produced between the conductive member 68 and the transfer device 36 through the paper.

In the process cartridge 46 in this embodiment, as described above, the shape and the capacity of the developer container 50 are changed by changing the shape of the lid member 55. At this time, at least one of the rotational center position of the agitator 54, the radius of rotation thereof, the number of rotations thereof, and length and thickness of the stir plate 56 of the agitator 54 is set according to the shape and the capacity of the developer container 50. For example, than the agitator 54 shown in FIG. 2A in case that the capacity of the developer container 50 is small, the agitator 54 shown in FIG. 2B in case that the capacity of the developer container 50 is large is longer in length of the stir plate 56 in order to make large the radius of rotation. Further, in the stir plate 56 having the same thickness, the longer its length is, the smaller the elastic power becomes. Therefore, in order to make the elastic power equal, the stir plate 56 shown in FIG. 2B is thicker than the stir plate 56 shown in FIG. 2A. Further, in this process cartridge 46, there are provided plural rotational shafts 59*a* and 59*b* of the agitator 54 which are different in position, and the rotational shaft is selected according to the shape and the capacity of the developer container 50. In FIG. 2A, the rotational shaft 59*a* is the rotational center position; and in FIG. 2B, the rotational shaft 59*b* is the rotational center position.

Hereby, supply power and a supply angle near the developer supplying port 60 when the developer is supplied to the developing part 52 by the stir plate 56 of the agitator 54 can be always made constant regardless of the shape and the capacity of the developer container 50. Here, to make constant the "supply power" and the "supply angle" is the same as to make constant "contact force F" and a "contact angle θ" of the stir plate 56 of the agitator 54 with the developer supplying port 60.

Figure 4A:
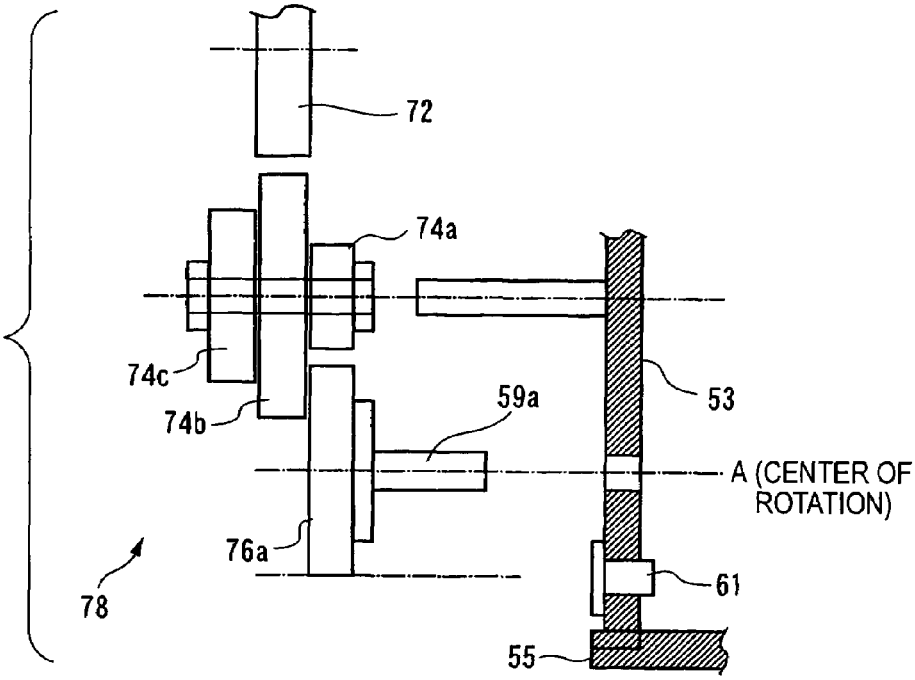
FIGS. 4A and 4B are conceptual illustrations showing a main part of the process cartridge according to the first embodiment of the invention.
Figure 4B:
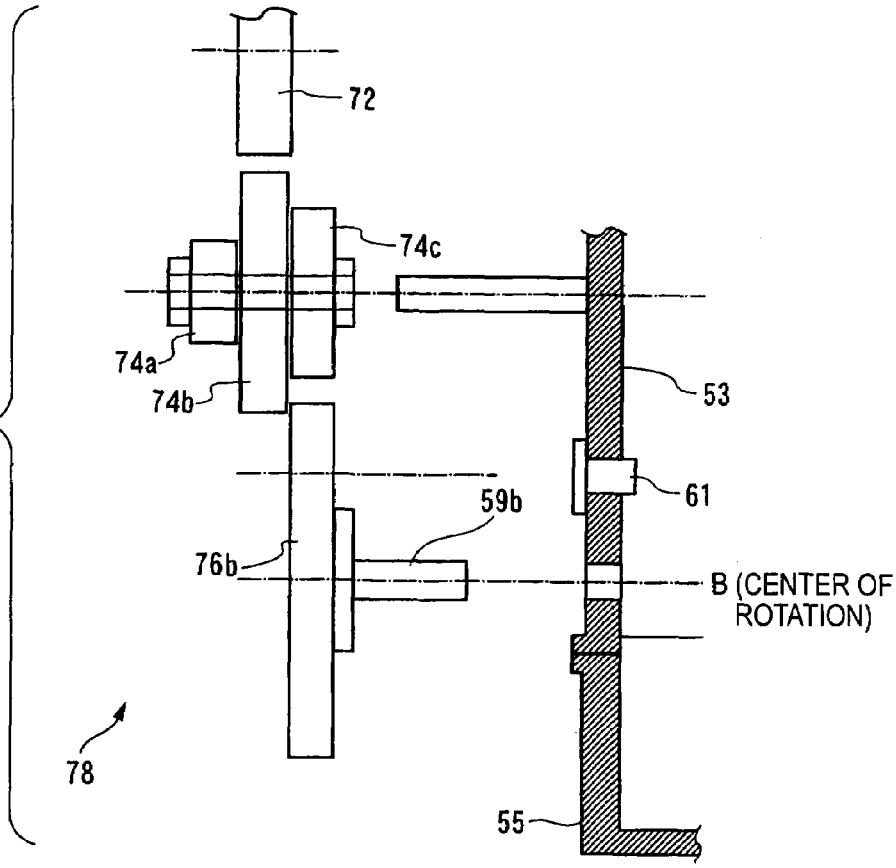

More specifically, in each of the process cartridges 46 as shown in FIGS. 2A and 2B in which the developer containers 50 of small capacity and large capacity are arranged, as shown in FIGS. 4A and 4B, a multi-step gear train 78 is provided in the developer container 50. The multi-step gear train 78 includes a drive gear 72; large and small transmission gears 74*a*, 74*b*, 74*c* for transmitting the drive force from this drive gear 72, which are arranged in three rows in the axial direction; and a stir gear 76*a* which is attached to the stir plate 56 of the agitator 54 to rotate the stir plate 56. In case of the process cartridge 46 shown in FIG. 2A in which the developer container 50 of the small capacity is arranged, the transmission gears 74*a* to 74*c* are composed of the largest transmission gear 74*b* which engages with the drive gear 72 and is located in the center in the axial direction, the transmission gear 74*a* which engages with the stir gear 76*a* and is located at one end of the transmission gear 74*b*, and the transmission gear 74*c* which is not used in this case and is located at the other end of the transmission gear 74*b*. Further, on the right side of the gear train 78 shown in FIG. 4A, side walls of the container body 53 of the developer container 50 and the lid member 55 are shown, and reference numeral 61 represents a cover lid member. Further, in the gear train 78 shown in FIG. 4A, the rotational center position, that is, the position of the rotational shaft 59*a* is a position A.

On the other hand, in case of the process cartridge 46 as shown in FIG. 2B in which the developing container 50 of the large capacity is arranged, as shown in FIG. 4B, the positions of the transmission gears 74*a* and 74*c* are exchanged, and further a stir gear 76*b* which is larger in radius of rotation than the stir gear 76*a* used in case of the developer container 50 of the small capacity is used. In this case, the rotational center position, that is, the position of the rotational shaft 59*b* is a position B in FIG. 4B. At this time, by forming the gear train 78 so that a relation of transmission gear 74*a*/stir gear 76*a*=transmission gear 74*c*/stir gear 76*b* is satisfied, the rotation speed of the stir plate 56 can be kept constant between the case of the developer container 50 of the small capacity and the case of the developer container 50 of the large capacity. By such the gear train 78, the drive gear 72 can rotate the stir gear 76*a* or 76*b* through the transmission gears 74*a* to 74*c*. Further, in FIGS. 4A and 4B, the drive gear 72 and the transmission gears 74*a* to 74*c* which are parts of the gear train 78 are used in common.

As described above, by making the radius of the stir gear 76*a* different from the radius of the stir gear 76*b*, the rotation radius of the stir plate 56 of the agitator 54 can be changed between the case of the developer container 50 of the small capacity and the case of the developer container 50 of the large capacity. Further, as described above, by changing the length and thickness of the stir plate 56 of the agitator 54, the developer supplying power and the developer supplying angle of the agitator 54 at the developer supplying port 60 can be made equal between the case of the developer container 50 of the small capacity and the case of the developer container 50 of the large capacity. Hereby, when the process cartridge 46 is partially used in common between the plural electrophotographic apparatuses, the contour and the shape of the developer container 50 can be freely set according to the electrophotographic apparatus. Further, the developer supplying amount to the developing part 52 by the developer stirring member 54 becomes constant regardless of the shape and the capacity of the developer container 50. Therefore, the image quality difference due to the amount of developer can not be caused.

Next, a process cartridge 46 according to a second embodiment will be described with reference to drawings.

Figure 5A:
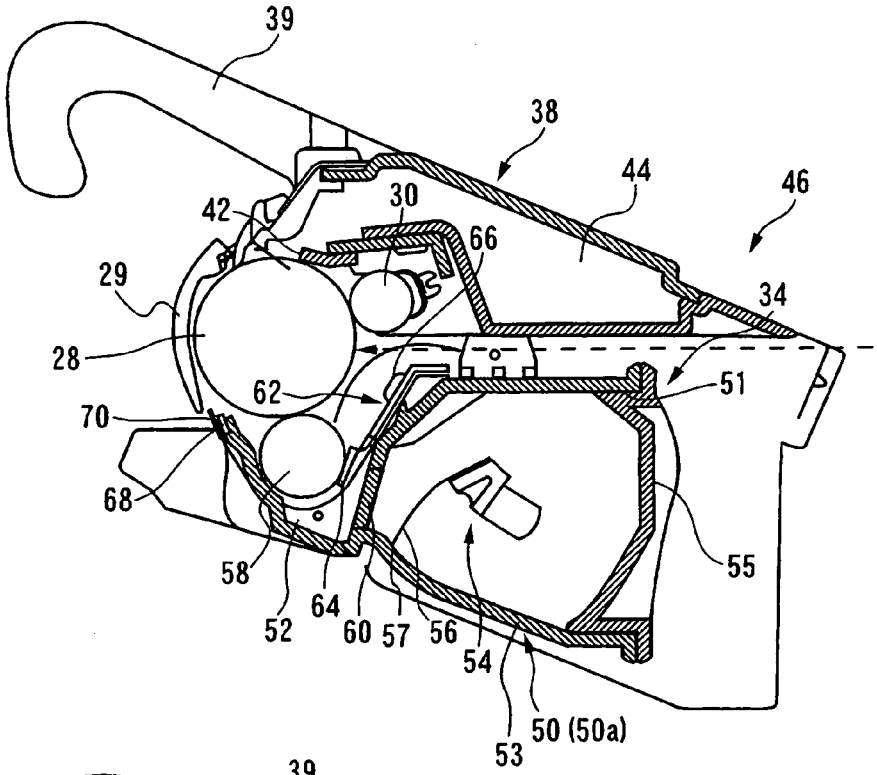
FIGS. 5A and 5B are section views showing an outline of a process cartridge according to a second embodiment of the invention.
Figure 5B:
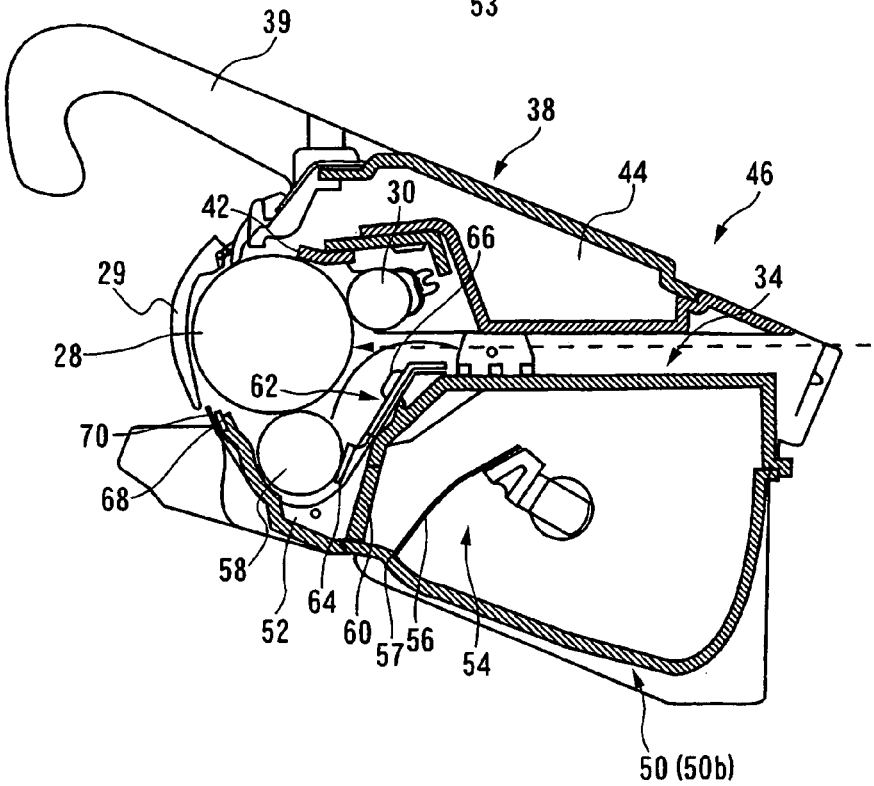

In the process cartridge 46 according to this embodiment, a developing part 52 is used in common, and a developer container 50 can be exchanged for another developer container 50 of the desired shape and capacity. Namely, for example, a developer container 50*a* of small capacity shown in FIG. 5A can be exchanged for a developer container 50*b* of large capacity shown in FIG. 5B. Hereby, the developing part 52 and the developer container 50*a*, 50*b* can be unitized, which is advantageous in assembly of the process cartridge 46. Further, also when the process cartridge 46 is reused, exchange for a developer container 50 according to needs can be performed.

In this embodiment, the developer container 50 is constituted detachably from the process cartridge 46 body. Hereby, a user can exchange the developer container 50 and can select the developer container 50 of the desired capacity and shape. Further, between various types of apparatuses, the developer container 50 can be used in common. Furthermore, when the process cartridge 46 is reused, regardless of the kind of the developer firstly used, for example, color developer or monochromatic developer, various kinds of developer can be used.

The developer container having the shape and the capacity which are suited to the desired amount of the housed developer can be obtained. Further, when the developing carting is partially used in common between the plural electrophotographic apparatuses, the invention can be applied to the developing cartridge which can set the contour and shape of the developing cartridge according to the electrophotographic apparatus.

What is claimed is:

1. A developing cartridge comprising:

a developing part having a developer bearing member;

a developer container which is constituted by coupling a container body having an opening part and a developer supplying port, and a lid member for closing the opening part, and which houses developer therein; and a developer stirring member which stirs the developer inside this developer container and supplies the developer to the developer bearing member, wherein the shape and the capacity of the developer container are changed by changing the shape of the lid member, and wherein plural rotation shafts of the developer stirring member are provided, which are different from each other in rotational center position, and selected and used according to the shape and the capacity of the developer container.

2. The developing cartridge according to claim 1, wherein:

a gear train in which gears for transmitting drive to the developer stirring member are arranged is provided in the developer container; the gears in the gear train are arranged in a multistep manner; and at least a part of the gear train is common and the partial gears of the gear train are recombined according to the rotational center position of the developer stirring member.

* * * * *